United States Patent [19]

Taniguchi et al.

[11] Patent Number: 4,906,841

[45] Date of Patent: Mar. 6, 1990

[54] CORONA DISCHARGE DEVICE

[75] Inventors: Masami Taniguchi, Osaka; Kiyoshige Kameda, Higashi-Osaka; Atsushi Kano, Amagasaki, all of Japan

[73] Assignee: Mita Industrial Co., Ltd., Osaka, Japan

[21] Appl. No.: 274,965

[22] Filed: Nov. 22, 1988

[30] Foreign Application Priority Data

Nov. 25, 1987 [JP] Japan ..... 62-178360[U]

[51] Int. Cl.[4] ..... H01T 19/00

[52] U.S. Cl. ..... 250/324; 250/325; 250/326

[58] Field of Search ..... 250/324, 325, 326; 346/159; 361/229, 230; 355/219, 221

[56] References Cited

U.S. PATENT DOCUMENTS 3,778,622 12/1973 Kobayashi et al. ..... 250/324
4,260,240 4/1981 Pieper ..... 355/221
4,585,321 4/1986 Toshimitsu et al. ..... 250/324
4,725,732 2/1988 Lang et al. ..... 250/324

*Primary Examiner*—Janice A. Howell
*Assistant Examiner*—Kiet Nguyen
*Attorney, Agent, or Firm*—Beveridge, DeGrandi & Weilacher

[57] ABSTRACT

A corona discharge device including a shield case having a bottom wall and a pair of walls extending from both side ends of the bottom wall and a wire stretched within the shield case. A guide member for preventing entry of a sheet material into the shield case has a guide arm portion extending across an opening of the shield case, and the free end portion of the guide arm portion is kept in elastic press contact with the wall of the shield case. Furthermore, the guide member for preventing entry of the sheet material into the shield case has one end portion fixed to one wall of the shield case and its other end portion detachably anchored selectively at one wall and the other wall of the shield case.

8 Claims, 3 Drawing Sheets

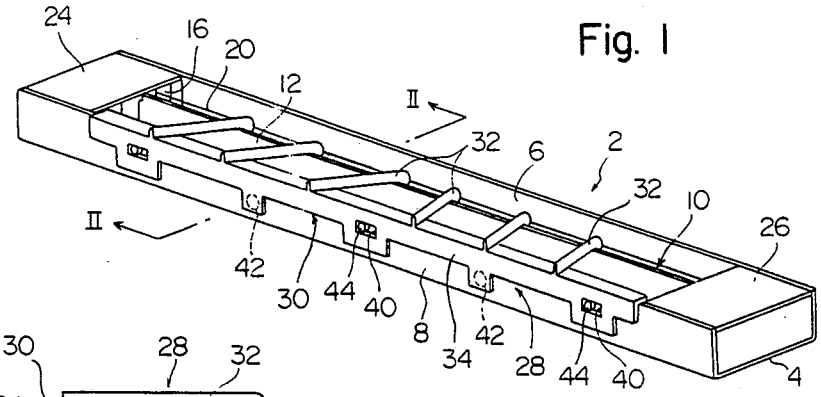
Fig. 1
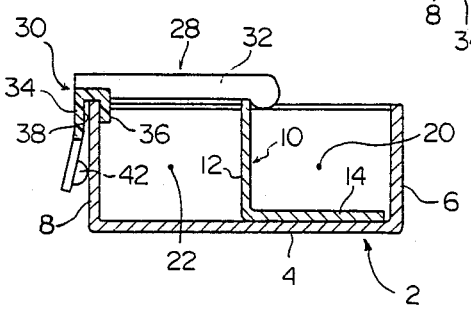
Fig. 2
Fig. 3
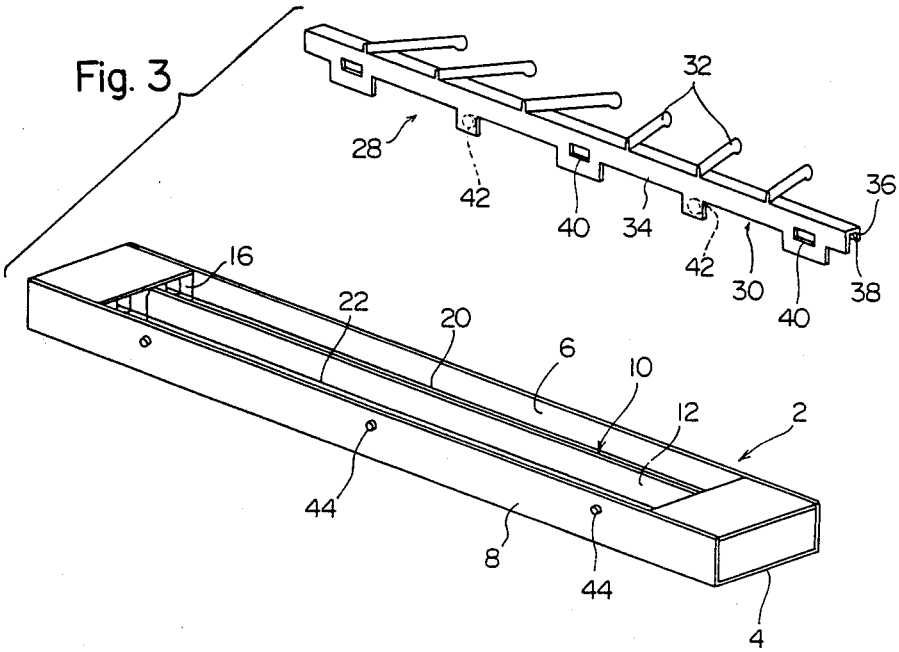

CORONA DISCHARGE DEVICE

FIELD OF THE INVENTION

This invention relates to a corona discharge device which can be utilized, for example, as a peeling corona discharge device in an electrostatic copying machine.

DESCRIPTION OF THE PRIOR ART

Generally, a peeling corona discharge device is widely utilized in an electrostatic copying machine in order to peel a sheet material such as a copying paper kept in intimate contact with a rotating drum in a transfer zone. The peeling corona discharge device is provided with an electrically conductive shield case and a wire stretched within the shield case, and a corona discharge generated from the wire is applied to the sheet material through an opening the the shield case.

The corona discharge device further comprises a guide means provided at the opening of the shield case to prevent entry of the sheet material through it. The guide means is made of, for example, a gut, a plastic film (see, for example, Japanese Laid-Open Utility Model Publication No. 120459/1985), or a plastic article (see, for example, Japanese Laid-Open Utility Model Publication No. 181456/1984).

Conventional corona discharge devices, however, have the following problems to be solved in regard to the guide means.

When the guide means is formed of a gut, it is troublesome to set it in a stretched state. When the wire is broken, it is troublesome and time-consuming to replace the wire. Cleaning of the wire is also not easy.

When the guide means is formed of a plastic film and set between a pair of side walls, the film is likely to get out of place in the event that a relatively thick sheet material acts on it, or in the case of disposing of jamming. Cleaning of the wire is not easy, either.

When the guide means is formed of a plastic article, deformation (so-called "warping") during molding causes part of the plastic article to rise at the time of setting it in the shield case. If this rising is large, the sheet material may collide with it, and it fails to guide the sheet.

SUMMARY OF THE INVENTION

It is a primary object of this invention to provide an improved corona discharge device which permits easy replacement of a wire and its cleaning, and can surely prevent entry of a sheet material into a shield case.

According to one aspect of the invention, there is provided a corona discharge device provided whith an electrically conductive shield case having a bottom wall and a pair of walls extending from both side ends of the bottom wall, a wire set in a stretched state within the shield case and a guide member for preventing entry of a sheet material into the shield case, wherein the guide member has a securing portion to be detachably mounted on one wall of the shield case and a guide arm portion extending from the securing portion to the other wall of the shield case across an opening formed in the shield case, the guide arm portion being in press contact with the upper edge of the other wall of the shield case by elastic deformation.

According to a second aspect of this invention, there is provided a corona discharge device provided with an electrically conductive shield case having a bottom wall and a pair of walls extending from both side ends of the bottom wall, a wire set in a stretched state within the shield case and a guide member for preventing entry of a sheet material into the shield case, wherein the guide member is formed of an elastically deformable film-like material with one end portion being fixed to one of the walls of the shield case and the other end portion being detachably anchored selectively at said one wall and the other wall, and when the other end portion of the guide member is anchored at the other wall, the guide member extends from one wall to the other cross an opening formed in the shield case, and when its other end portion is anchored at said one wall, the opening of the shield case is exposed.

BRIEF DESCRIPTION OF THE DRAWINGS

FIG. 1 is a perspective view of a corona discharger to which a first embodiment of the corona discharge device of the invention is applied;

FIG. 2 is a sectional view taken along line II—II of FIG. 1;

FIG. 3 is a perspective view showing the corona discharger of FIG. 1 in which the guide member is removed from the case;

DETAILED DESCRIPTION OF THE PREFERRED EMBODIMENT

Figure 4:
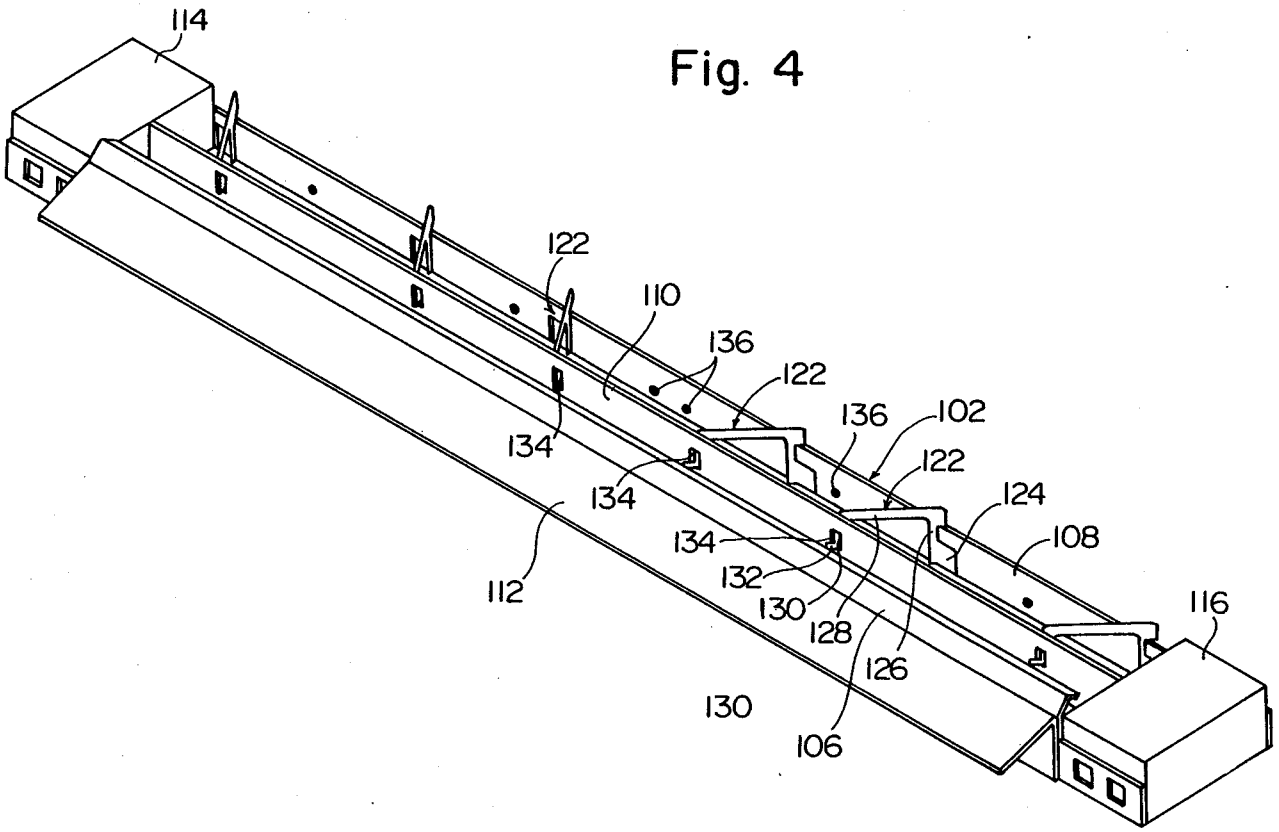
FIG. 4 is a perspective view showing a corona discharger to which a second embodiment of the corona discharge device of the invention is applied.

The invention will be described in detail with reference to the drawings.

First Embodiment

FIGS. 1 to 3 show a corona discharger to which the first embodiment of the corona discharge device of the invention is applied. With reference mainly to FIGS. 1 and 2, the illustrated corona discharger is provided with an electrically conductive case 2 made of a metallic material such as aluminum. The case 2 has a rectangular bottom wall 4 and side walls 6 and 8 extending substantially perpendicularly from both side ends of the bottom wall 4, and an electrically conductive partitioning wall 10 formed of a metallic material is disposed between both side walls 6 and 8. The partitioning wall 10 is nearly L-shaped. Its partitioning portion 12 extends longitudinally of the case 2 in a substantially central part between the side walls 6 and 8, and its securing portion 14 is fixed to the inner surface of the right portion in FIG. 2 of the bottom wall 4 by welding or otherwise. With this arrangement, a shield case on the right side of FIG. 2 comprised of the side wall 6 and the partitioning wall 10 (the partitioning portion 12 and the securing portion 14) functions as a shield case of one corona discharge device. A shield case comprised of the side wall 8, the left portion of the bottom wall 4 in FIG. 2, and the partitioning portion 12 of the bottom wall 10 functions as a shield case for the other corona discharge device.

With reference mainly to FIGS. 1 and 3, supporting members 16 (only one of which is shown in FIGS. 1 to 3) formed of an insulation material such as a synthetic material are mounted on both end portions of the case 2, more specifically its both end portions between the side walls 6 and 8. A pair of wires 20 and 22 are stretched between these supporting members 16. As shown in FIGS. 2 and 3, one wire 20 extends between the side wall 6 and the partitioning portion 12 of the partitioning wall 10 longitudinally therealong, and its both end portions are fixed in place to the right portions of the supporting members 16 in FIG. 2. The other wire 22 extends between the side wall 8 and the partitioning portion 12 of the partitioning wall 10 longitudinally therealong, and its both end portions are fixed in place to the left portions of the supporting members 16 in FIG. 2. Cover members 24 and 26 are attached to the opposite end portions of the case 2. One cover member 24 extends from the side wall 6 to the side wall 8 at the left end portion of the case 2 in FIGS. 1 and 3, and covers on supporting member 16. The other cover member 26 extends from the side wall 6 to the side wall 8 at the right end portion of the case 2 in FIGS. 1 and 3, and covers the other supporting member 16 (not shown).

The corona discharger is disposed, for example, in a transfer zone opposite to a rotating drum (not shown) of an electrostatic copying machine. Accordingly, as can be easily seen, one corona discharging device comprising the shield case composed of the side wall 6 and the partitioning wall 10 and one wire 20 functions as a transfer corona discharge device for transferring a toner image formed on the surface of a photosensitive material on the rotating drum to a sheet material such as copying paper, and applies a corona discharge from the wire 20 to the back surface of the sheet material through an upper surface opening defined between the side wall 6 and the partitioning portion 12 of the partitioning wall 10. The other corona discharge device comprising the shield case composed of the side wall 8, the left part of the bottom wall 4 in FIG. 2, and the partitioning portion 12 of the partitioning wall 10 and the other wire 22 functions as a peeling corona discharge device for peeling the sheet material in intimate contact with the surface of the photosensitive material on the rotating drum, and applies a corona discharge from the wire 22 to the back surface of the sheet material kept in intimate contact with the rotating drum through an upper surface opening defined between the side wall 8 and the partitioning portion 12 of the partitioning wall 10.

The corona discharger is provided with a guide member 28 disposed in relation to the corona discharge device on the left side of FIG. 2 (i.e., the one which functions as a peeling corona discharge device). The illustrated guide member 28 has a securing portion 30 and a plurality of (6 in the illustrated embodiment) guide arm portions 32 extending from the securing portion 30. In the illustrated embodiment, the securing portion 30 and the guide arm portions 32 are molded from a synthetic resin as a one-piece unit. The securing portion 30 has an outside wall portion 34 and an inner wall portion 36 extending longitudinally in spaced-apart relationship, and a securing depression 38 is defined between the outer wall portion 34 and the inside wall portion 36 (see FIG. 2). A plurality of (3 in the illustrated embodiment) rectangular openings 40 are formed in the outside wall portion 34 longitudinally thereof in spaced-apart relationship. On the inside surface of the outside wall portion 34 (specifically, sites between the sites of the openings 40), a plurality of (2 in the illustrated embodiment) nearly hemispherical protrusions 42 are provided integrally in spaced-apart relationship in the longitudinal direction. In providing the openings 40 and/or the protrusions 42, it is possible to project part of the outside wall 34 slightly as in the illustrated embodiment, and form the openings 40 and/or the protrusions 42 in the projecting portion. Alternatively, it is possible to extend the entire outside wall portion 34 further, and form the openings 40 and/or the protrusions 42 in the extended portion. The guide arm portions 32 extend from the securing portion 30 to which they are connected to the right in FIG. 2, and to the right top in FIG. 3. The guide arm portions 32 are preferably constructed as shown in FIGS. 1 and 3. Specifically, it is preferred that with the longitudinally cental part of the guide member 28 as a standard, the guide arm 32 positioned on one side thereof (the left portion in FIGS. 1 and 3) be inclined in a straight line inwardly (to the right in FIGS. 1 and 3) toward the free end portion, and the guide arm portion 32 positioned on the other side of the standard (the right portion in FIGS. 1 and 3) be inclined in a straight line inwardly (to the left in FIGS. 1 and 3) toward the free end portion . The free end portion of each guide arm portion 32 is nearly spherical as shown.

Correspondingly to the openings 40 formed in the guide member 28, anchoring protrusions 44 are provided on the outside surface of the side wall 8 of the case 2. The anchoring protrusions 44 can be formed in the side wall 8 by, for example, press working.

The guide member 28 is detachably mounted as shown in FIGS. 1 and 2. Specifically, the securing depression 38 defined in the securing portion 30 of the guide member 28 is brought into alignment with the side wall 8 of the case 2, and then the securing portion 30 is depressed downwardly. As a result, the upper end portion of the side wall 8 is inserted between the outside wall portion 34 positioned outwardly and the inside wall portions 36 positioned inwardly, and the guide member 28 is detachably loaded into the case 2. In this loaded state, the anchoring protrusions 44 provided in the side wall 8 are positioned in the corresponding openings 40 formed in the securing portion 30 to restrain the vertical and longitudinal movements of the guide member 28 with respect to the side wall 8 and prevent detachment of the guide member 28 from the side wall 8, as shown in FIG. 1. Furthermore, in this loaded state, each of the guide arm portions 32 extends across the upper surface opening from one side wall of the shield case in the corona discharge device functioning as the peeling corona discharge device functioning as the peeling corona discharge device (i.e., the side wall 8 of the case 2) to the other side wall (i.e., the partitioning portion 12 of the partitioning wall 10), and its free end portion slightly projects toward the side wall 6 beyond the partitioning portion 12. Accordingly, the sheet material peeled from the rotating drum (not shown) is conveyed downstream while being guided by the guide arm portions 32 and its entry into the peeling corona discharge device is accurately hampered, as shown in FIGS. 1 and 2. Moreover, in the above loaded state, the protrusions 42 provided in the outside wall portion 34 of the securing portion 30 act on the side wall 8 of the case 2, as shown in FIG. 2. Hence, the inside portion 36 of the securing portion 30 is kept in press contact with the inside surface of the side wall 8 and the outside wall portion 34 is elastically deformed slightly to the left in FIG. 2. The elastic deformation of the securing portion 30 biases the guide arm portions 32 clockwise in FIG. 2 with the base portion as a fulcrum. Accordingly, the free end portions of the guide arm portions 32 are kept in press contact with the upper edge of the partitioning portion 12 by their own elastic deformation, and no space is substantially formed between the lower edges of the guide arm portions 32 and the upper edge of the partitioning portion. Consequently, entry of the sheet material between the partitioning portion 12 of the partitioning wall 10 and the guide member 28 can be accurately prevented. Furthermore, the elastic deformation of the guide member 28 can effectively compensate for any "warping" of the guide member which occurred during molding, and the guide arm portions 32 are not partly raised.

To detach the guide member 28 from the side wall 8 of the case 2, the guide member 28 is relatively strongly pushed up in FIG. 2 with respect to the case 2. This causes disengagement between the openings 40 formed in the securing portion 30 and the anchoring protrusions 44 formed in the side wall 8, and the guide member 28 is detached from the side wall 8 as is required.

Accordingly, in the above corona discharger, the guide member 28 can be easily loaded into, and detached, from the side wall 8. In this regard, the wire 22 can be cleaned and replaced easily.

In the illustrated embodiment, the protrusions 42 for elastically deforming the guide member 28 are provided on the securing portion 30 of the guide member 28 (more specifically, in the inside surface of the outside wall portion 34). If desired, protrusions for elastically deforming the guide member 28 may be provided on the outside surface of the side wall 8.

Second Embodiment

Figure 5:
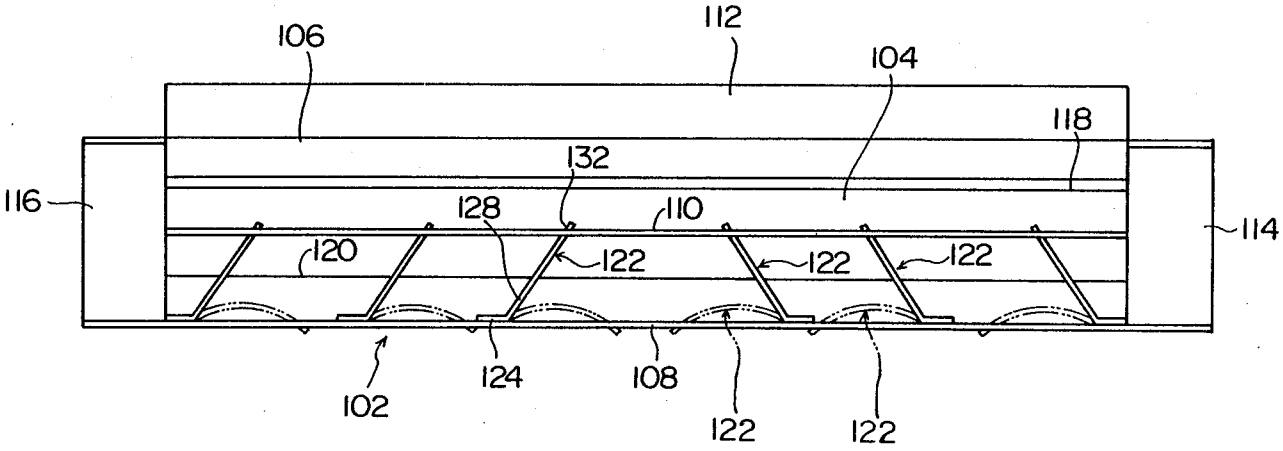
FIG. 5 is a top plan view of the corona discharge device of FIG. 4.

FIGS. 4 and 5 show a corona discharger to which a second embodiment of the corona discharge device in accordance with this invention is applied.

In FIGS. 4 and 5, the illustrated corona discharger is provided with an electrically conductive case 102 formed of a metallic material such as aluminum. The case 102 has a bottom wall 104 and side walls 106 and 108 projecting upwardly substantially vertically from both side ends of the bottom wall 104. Between the side walls 106 and 108 is disposed an electrically conductive partitioning wall 110 formed of a metallic material and the lower end of the partitioning wall 110 is fixed to the bottom wall 104 by such means as welding. With this arrangement, as in the first embodiment, a shield case comprised of the bottom wall 104 (the lower portion in FIG. 5), the side wall 108 and the partitioning wall 110 functions as a shield case for one corona discharge device, and a shield case comprised of the bottom wall 104 (the upper portion in FIG. 5), the side wall 106 and the partitioning wall 110 functions as a shield case for the other corona discharge device. In the second embodiment, the upper portion of one side wall 106 is slightly inwardly bent toward the partitioning wall 110, and a guide member 112 is fixed to the outside surface of the side wall 106 and its one side portion projects outwardly, as shown in FIG. 4.

Supporting members 114 and 116 formed of an insulation material such as a synthetic resin material are attached to both end portions of the case 102, and wires 118 and 120 are stretched between the suppoting members 114 and 116 (see FIG. 5). One wire 118 extends along and between the side walls 106 and the partitioning wall 110, and the other wire 120 extends along and between the side wall 108 and the partitioning wall 110.

The corona discharger, as in the first embodiment, is disposed in a transfer zone opposite to the rotating drum (not shown) of an electrostatic copying machine. One corona discharge device including a shield case composed of the bottom wall 104, the side wall 106 and the partitioning wall 110 and one wire 118 functions as a transfer corona discharge device, and the other corona discharge device including a shield case composed of the bottom wall 104, the side wall 108 and the partitioning wall 110 and the wire 120 functions as a peeling corona discharge device.

A guide member 122 is further disposed in regard to the other corona discharge device in the corona discharger described. The guide member 122 is formed of a film-like material which can be formed of a synthetic resin material such as a polyester or a vinyl chloride resin, and can be elastically deformed from a position shown in FIG. 4 and by a solid line in FIG. 5 to a position shown by a two-dot chain line in FIG. 5. In the illustrated embodiment, six guide members 122 in total are disposed in spaced-apart relationship longitudinally of the side wall 108 and the partitioning wall 110. With the longitudinally central part of the side wall 108 as a standard, three guide members 122 are provided on one side thereof (the left side in FIG. 5), and three guide members 122 are provided on the other side (the right side in FIG. 5).

The guide members 122 are of substantially the same structure. Each of the guide members 122 has a fixed portion 124 provided at one end portion, a projecting portion 126 extending upwardly from the fixed portion 124, a guide portion 128 extending substantially horizontally from the upper end of the projecting portion 126, a suspending portion 130 extending downwardly from the end of the guide portion 128, and an anchoring projection 132 projecting nearly horizontally from the lower end of the suspending portion 130. The fixed portion 124 is fixed to the inside surface of the side wall 108 by an adhesive or a both-surface adhesive tape.

A rectangular first hole 134 is formed in the partitioning wall 110 corresponding to each guide member 122. As shown in FIGS. 4 and 5, first holes 134 provided correspondingly to the guide members 122 disposed on one side of the longitudinally central part of the side wall 108 are positioned inwardly of the fixed portions 124 of the guide members 122, namely to the right in FIG. 5. The first holes 134 provided correspondingly to the guide members 122 disposed on the other side of the aforesaid standard are positioned inwardly of the fixed portions 124 of the guide members 122, namely to the left in FIG. 5. Furthermore, second holes 136 are formed in the side wall 108 correspondingly to the guide members 122. The second holes 136 are positioned further inwardly of the first holes 134. In the second embodiment, the free end portion of each guide member 122 is adapted to be selectively anchored at the partitioning wall 110 and the side wall 108. Usually, in use, the anchoring projections 132 of the guide members 122 are anchored at the corresponding first holes 134, and in the anchored state, the foward ends of the anchoring projections 132 project slightly toward the side wall 106 through the partitioning wall 110. In this anchored state, as shown in FIG. 5, the guide portions 128 of the guide members 122 positioned on one side (the left side in FIG. 5) of the side wall 108 extend inclinedly from one end toward the other inwardly to the right in FIG. 5. The guide portions 128 of the guide members 122 positioned on the other side (on the right side in FIG. 5) of the side wall 108 extend inclinedly from one end toward the other inwardly to the left in FIG. 5. As shown in FIG. 4, the guide portions 128 of the guide members 122 cross the side walls 108 and 110 while slightly projecting beyond the upper ends of the partitioning wall 110 and the side wall 108. Accordingly, the guide members 122 guide the sheet member properly and accurately prevent entry of the sheet material into the shield case of the corona discharge device functioning as a peeling corona discharge device, i.e. into the space between the partitioning wall 110 and the side wall 108. Furthermore, since one end portion of each guide member 122 is fixed to the side wall 108, the action of the sheet material, etc. on the guide members 122 does not result in detachment of the guide members 122 from the case 102.

On the other hand, when the wire 120 is to be cleaned or replaced, the anchoring projections 132 of the guide members 122 are anchored at the corresponding second hole 136. As can be seen from FIG. 5, this anchoring can be achieved by detaching the anchoring projections 132 of the guide members 122 from the first holes 134, and then elastically deforming them inwardly (clockwise in FIG. 5 for the guide members 122 positioned on one side of the side wall 108, and counterclockwise in FIG. 5 for the guide members 122 positioned on the other side of the side wall 108) and anchoring them in the second holes 136. Consequently, the end portions of the anchoring projections 132 project slightly outwardly through the side wall 108. In this anchored state, the guide portions 128 of the guide membes 122 extend nearly in the left-right direction in FIG. 5 inwardly of the side wall 108 along its inside surface to expose the overhead space of the wire 120. As a result, the wire can be cleaned and replaced easily.

Figure 6:
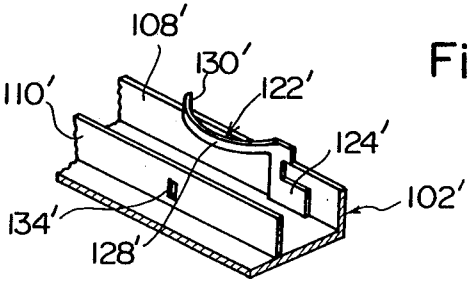
FIG. 6 is a perspective view showing part of a modified example of the corona discharge device of FIG. 4.

FIG. 6 shows a modified example of the corona discharger shown in FIGS. 4 and 5. In this modified example, the height of the side wall 108' of the case 102' is slightly lower than that of the partitioning wall 110', and the guide portion 128' as a whole of the guide member 122' projects upwardly beyond the upper edge of the side wall 108'. With this arrangement, in guiding the sheet material, the anchoring projection provided at the lower end of the suspending portion 130' of the guide member 122' is anchored at the hole 134' formed in the partitioning wall 110'. When the space between the partitioning wall 110' and the side wall 108' is to be opened, the guide member 122' is elastically deformed and its suspending portion 130' is detachably anchored at the upper edge of the side wall 108', as shown in FIG. 6. Accordingly, the second holes can be omitted. In this modified example, too, the fixing portion 124 of the guide member 122' is fixed to the inside surface of the side wall 108', and the same result as in the second embodiment can be achieved.

While the various embodiments of the corona discharge device in accordance with this invention have been described, it should be understood that the invention is not limited to these specific embodiments, and various changes and modifications are possible without departing from the scope of the invention.

For example, the above embodiments have been described with reference to one corona discharge device of the corona discharger composed of two corona discharge devices. This is not limitative, and the description equally applies to a single corona discharge device.

We claim:

1. A corona discharge device provided with an electrically conductive shield case having a bottom wall and a pair of walls extending from both side ends of the bottom wall, a wire set in a stretched state within the shield case and a guide member for preventing entry of a sheet material into the shield case, wherein the guide member has a securing portion to be detachably mounted on one wall of the shield case and a guide arm portion extending from the securing portion to the other wall of the shield case across an opening formed in the shield case, the guide arm portion being in press contact with the upper edge of the other wall of the shield case by elastic deformation.

2. The corona discharge device of claim 1 in which the securing portion of the guide member has provided therein protrusion so that when the securing portion is detachably mounted on one of the walls, the guide member is slightly deformed elastically.

3. The corona discharge device of claim 2 in which the securing portion of the guide member has an inside wall portion to be positioned inwardly of said one wall and an outside wall portion to be positioned outwardly of said wall, and said protrusion for slightly deforming the guide member elastically by action on said one wall is provided on the inside surface of the outside wall portion.

4. A corona discharge device provided with an electrically conductive shield case having a bottom wall and a pair of walls extending from both side ends of the bottom wall, a wire set in a stretched state within the shield case and a guide member for preventing entry of a sheet material into the shield case, wherein the guide member is formed of an elastically deformable film-like material with one end portion being fixed to one of the walls of the shield case and the other end portion being detachably anchored selectively at said one wall and the other wall, and when the other end portion of the guide member is anchored at the other wall, the guide member extends from one wall to the other across an opening formed in the shield case, and when its other end portion is anchored at said one wall, the opening of the shield case is exposed.

5. The corona discharge device of claim 4 in which the other wall has formed therein a first hole at which the other end portion of the guide member is adapted to be detachably anchored.

6. The corona discharge device of claim 4 in which at that site of said one wall which is apart from the side of mounting one end portion of the guide member, a second hole is formed at which the other end portion of the guide member is adapted to be detachably anchored.

7. The corona discharge device of claim 4 in which an anchoring suspending portion is provided in the other end portion of the guide member, and the suspending portion is anchored detachably at the upper edge of said one wall.

8. The corona discharge device of claim 4 in which a plurality of said guide members are disposed in spaced-apart relationship longitudinally of the shield case, and with the longitudinally central part of the shield case as a standard, those guide members which are arranged on one side thereof and those which are arranged on the other side extend inclinedly from said one wall toward said other wall inwardly, and when the opening of the shield case is to be opened, said guide members arranged on one side and said guide members arranged on the other side are elastically deformed inwardly and anchored at said one wall.

* * * * *